US006694640B1

(12) United States Patent
Kayser

(10) Patent No.: US 6,694,640 B1
(45) Date of Patent: Feb. 24, 2004

(54) CALENDER HUMIDITY CONTROL SYSTEM AND METHOD

(75) Inventor: Franz Kayser, Geldern (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 80 days.

(21) Appl. No.: 09/497,797

(22) Filed: Feb. 4, 2000

(30) Foreign Application Priority Data

Feb. 6, 1999 (DE) ..... 199 04 891

(51) Int. Cl.[7] ..... F26B 5/04

(52) U.S. Cl. ..... 34/402; 34/114; 34/116; 34/122; 34/444; 34/445; 34/557

(58) Field of Search ..... 34/114, 116, 122, 34/444, 445, 446, 474, 476, 491, 528, 557

(56) References Cited

U.S. PATENT DOCUMENTS

| | | | | |
|---|---|---|---|---|
| 4,836,894 A | * | 6/1989 | Chance et al. | 162/253 |
| 5,651,863 A | * | 7/1997 | Van Haag et al. | 162/207 |
| 5,694,848 A | * | 12/1997 | Palmatier | 101/219 |
| 5,915,473 A | * | 6/1999 | Ganesh et al. | 165/222 |
| 5,966,834 A | * | 10/1999 | Steiner et al. | 34/116 |
| 6,003,440 A | * | 12/1999 | Koskinen et al. | 100/35 |

FOREIGN PATENT DOCUMENTS

| | | |
|---|---|---|
| DE | 4412625 | 10/1995 |
| DE | 19929661 | 1/2000 |

OTHER PUBLICATIONS

Advertisement: "The New Supercalender Concepts".

* cited by examiner

*Primary Examiner*—William C. Doerrler
*Assistant Examiner*—Mark Shulman
(74) *Attorney, Agent, or Firm*—Greenblum & Bernstein, P.L.C.

(57) ABSTRACT

A calender, a system, and a method of regulating the humidity in a calender. The calender includes a housing having at least two side pieces and a roll stack located at least partially between the side pieces, wherein a space is formed by the roll stack and the web between the side pieces, and a fan positioned to blow dry air into the space. The system is for regulating the humidity in a calender, the calender being used to treat a moisture-containing material web and including a housing having at least two side walls and a roll stack, the calender defining a space bounded at least by the roll stack, the web, and the at least two side walls, and includes a device for reducing the humidity of the space, wherein the humidity level in the space is reduced to a level which is below a saturation point. The method includes reducing the humidity of the space, wherein the humidity level in the space is reduced to a level which is below a saturation point.

42 Claims, 1 Drawing Sheet

1
2
3
4
5
6
7
8
9
10
11
12
13
14
15
15'
16
16'
17
18
19
20
21

CALENDER HUMIDITY CONTROL SYSTEM AND METHOD

CROSS-REFERENCE TO RELATED APPLICATIONS

The present application claims priority under 35 U.S.C. §119 of German Patent Application No. 199 04 891.6, filed on Feb. 6, 1999, the disclosure of which is expressly incorporated by reference herein in its entirety.

BACKGROUND OF THE INVENTION

1. Field of the Invention

The invention relates to a calender, a system, and a method for reducing the humidity in a calender for webs of moisture-containing material, such as paper, with a housing having two side pieces and a roll stack, in which a space limited at least by the roll stack and the web is situated between the side pieces.

2. Discussion of Background Information

The space between the side pieces (or side walls) of a housing is customarily limited at one vertical or oblique face by the roll stack and is limited below by the floor of the workshop. If additional limits are formed by the web, for example, on the upper side and at the face opposite to the roll stack, a largely closed space is formed which is interchangeable with the ambient atmosphere only to a slight extent. This is particularly true for an in-line calender arranged near the drying cylinder of a paper machine, and also for an off-line calender with a closely adjacent unwinding device.

Since this limited space is incompletely connected to the ambient atmosphere, the air humidity inside it can rise due to the moisture of the paper web or of a steam moisturizing insert. As a result, the air in the limited space can become saturated, such that fog droplets form. In addition, the moisture can condense on the colder components, such as the housing, for example, which leads to the problem of corrosion. Moreover, there is a constant concern that droplets will fall onto the web from calender components, and this is undesirable. Additionally, the high humidity is also unpleasant for the service personnel who must enter this space.

SUMMARY OF THE INVENTION

The invention provides a calender of the initially described type with which the humidity problems are solved, while the limits of the space are maintained.

This is achieved according to the invention by a system which removes moisture from the air in the limited space by a number of methods, such as by introducing dry air into the limited space. A process which reduces the moisture in the limited space is also disclosed.

The embodiment of adding dry air has a two-fold effect. First, a slight over pressure is formed in the limited space, by which moist air is forced out into the environment via the still remaining openings. Secondly, the dry state of the fan air ensures that the humid atmosphere in the limited space does not reach the saturation state and thus the problem of the formation of droplets is avoided. The atmosphere is also made considerably more pleasant for the service personnel.

It is also possible to provide a heating device for the blast air. The blast air can therefore be fed in at a higher temperature and thus further improve the drying effect on the air in the limited space.

The invention contemplates using at least one moisture sensor and/or at least one temperature sensor arranged within the limited space, and a computer is provided that analyzes the values measured by the sensors and calculates a desired blast air state which is sufficient to avoid the saturation state in the limited space. Moreover, a computer-controlled system is provided for adjusting the state of blast air. By monitoring the atmosphere in the limited space and controlling or regulating the blast air state dependent on the values measured by the sensors, it is ensured that a saturation point of the moist air in the limited space is not reached.

For this purpose, the system may utilize a device such as a fan or other air exchange devices (i.e., air delivery or air removal devices) for adjusting the amount of blast air which enters the limited space. Moreover, a device such as a heating device can be used for adjusting the temperature of the blast air before it enters the limited space.

The invention also contemplates the utilization of a computer and a computer program for regulating, maintaining, and/or precisely controlling the air in the limited space at a level which is close to the saturation state. This ensures that the web, which borders the space and is transported through the space in the region of the roll stack, is not over dried.

The invention provides a calender for webs of moisture-containing material, including a housing having at least two side pieces and a roll stack located at least partially between the side pieces, wherein a space is formed by the roll stack and the web between the side pieces, and a fan positioned to blow dry air into the space. The material web may be a paper web. The dry air blown into the space may have a relative humidity which is lower than the relative humidity of the air disposed in the space. The calender may also include a heating device for heating the dry air. The calender may include at least one moisture sensor for measuring a humidity of the space and communicating the measurement to a computer. The calender may include at least one temperature sensor for measuring a temperature of the space and communicating the measurement to a computer. Moreover, the calender may include a computer which receives inputs from the at least one moisture sensor and the at least one temperature sensor for adjusting the humidity of the space. The calender may further include an air adjusting device for regulating one of the air velocity entering the space and the quantity the air entering the space. The air adjusting device may be a computer controlled fan adjusting motor. A temperature adjusting device for regulating the temperature of the dry air entering the space may also be utilized. The temperature adjusting device may be a computer controlled adjustable heating current regulator.

The invention may also utilize a computer program which manipulates input measurements from the at least one moisture sensor and the at least one temperature sensor and calculates outputs for regulating the humidity level within the space in the range of between approximately 75% and 95%.

According to another aspect of the invention, there is provided a system for regulating the humidity in a calender, the calender being used to treat a moisture-containing material web and including a housing having at least two side walls and a roll stack, the calender defining a space bounded at least by the roll stack, the web, and the at least two side walls, the system including a device for reducing the humidity of the space, wherein the humidity level in the space is reduced to a level which is below a saturation point. The device for reducing the humidity may be an air exchange device. The device for reducing the humidity may be a fan for removing air from the space. The device for reducing the humidity may also be a fan for blowing air into the space. The system may further include a heating device for heating the air. The system may use at least one moisture sensor for measuring a humidity in the space and communicating the measurement to a regulating device. The system may employ at least one temperature sensor for measuring a temperature in the space and communicating the measurement to a regulating device. The regulating device may be a computer which receives inputs from the at least one moisture and the at least one temperature sensors for adjusting the humidity of the space. The system may also provide for a an air adjusting device for regulating one of the air velocity entering the space and the quantity the air entering the space. The air adjusting device may be a computer controlled fan adjusting motor. The system can include a temperature adjusting device for regulating the temperature of the air entering the space. The temperature adjusting device may be a computer controlled adjustable heating current regulator. The system can utilize a computer program which manipulates input measurements from the at least one moisture sensor and the at least one temperature sensor and calculates outputs for regulating the humidity level within the space in the range of between approximately 75% and 95%.

According to still another aspect of the invention, there is provided a method of regulating the humidity in a calender, the calender being used to treat a moisture-containing material web and including a housing having at least two side walls and a roll stack, the calender defining a space bounded at least by the roll stack, the web, and the at least two side walls, the method including reducing the humidity of the space, wherein the humidity level in the space is reduced to a level which is below a saturation point. The reducing may include exchanging the air within the space with an air exchange device. The reducing may include introducing air to the space using a fan. The reducing may include removing air to the space using an exhaust fan. The method may provide for introducing air to the space using a fan. The method may include measuring the humidity in the space with at least one sensor. The method may also include regulating the humidity of the space using a control device which receives inputs from the at least one sensor. The method may provide for regulating the humidity of the space using a regulating device which receives inputs from the at least one moisture sensor. The method may employ regulating the humidity of the space using a control device which receives inputs from the at least one temperature sensor. The regulating may include maintaining the humidity in the space in the range of between approximately 75% and 95%.

The invention also contemplates a system for regulating the humidity in a calender, the calender being used to treat a moisture-containing material web and including a housing having at least two side walls and a roll stack, the calender defining a space bounded at least by the roll stack, the web, and the at least two side walls, the system including a device for reducing the humidity of the space, at least one moisture sensor disposed within the space, at least one temperature sensor disposed within the space, a control device for receiving inputs from the at least one moisture sensor and the at least one temperature sensor, wherein the control device controls the device for reducing the humidity so as to regulate the humidity level in the space to a point which is below a saturation point.

The invention further contemplates a method of regulating the humidity in a calender, the calender being used to treat a moisture-containing material web and including a housing having at least two side walls and a roll stack, the calender defining a space bounded at least by the roll stack, the web, and the at least two side walls, the method including measuring the humidity within the space with at least one moisture sensor, measuring the temperature within the space with at least one temperature sensor, comparing the humidity of the space to a desired value in a range using a computer which receives inputs from the at least one moisture sensor and the at least one temperature sensor, and regulating the humidity of the space to the desired value, wherein the humidity level in the space is reduced to a level which is within the range of between approximately 75% and 95%.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

Figures 1, 2:
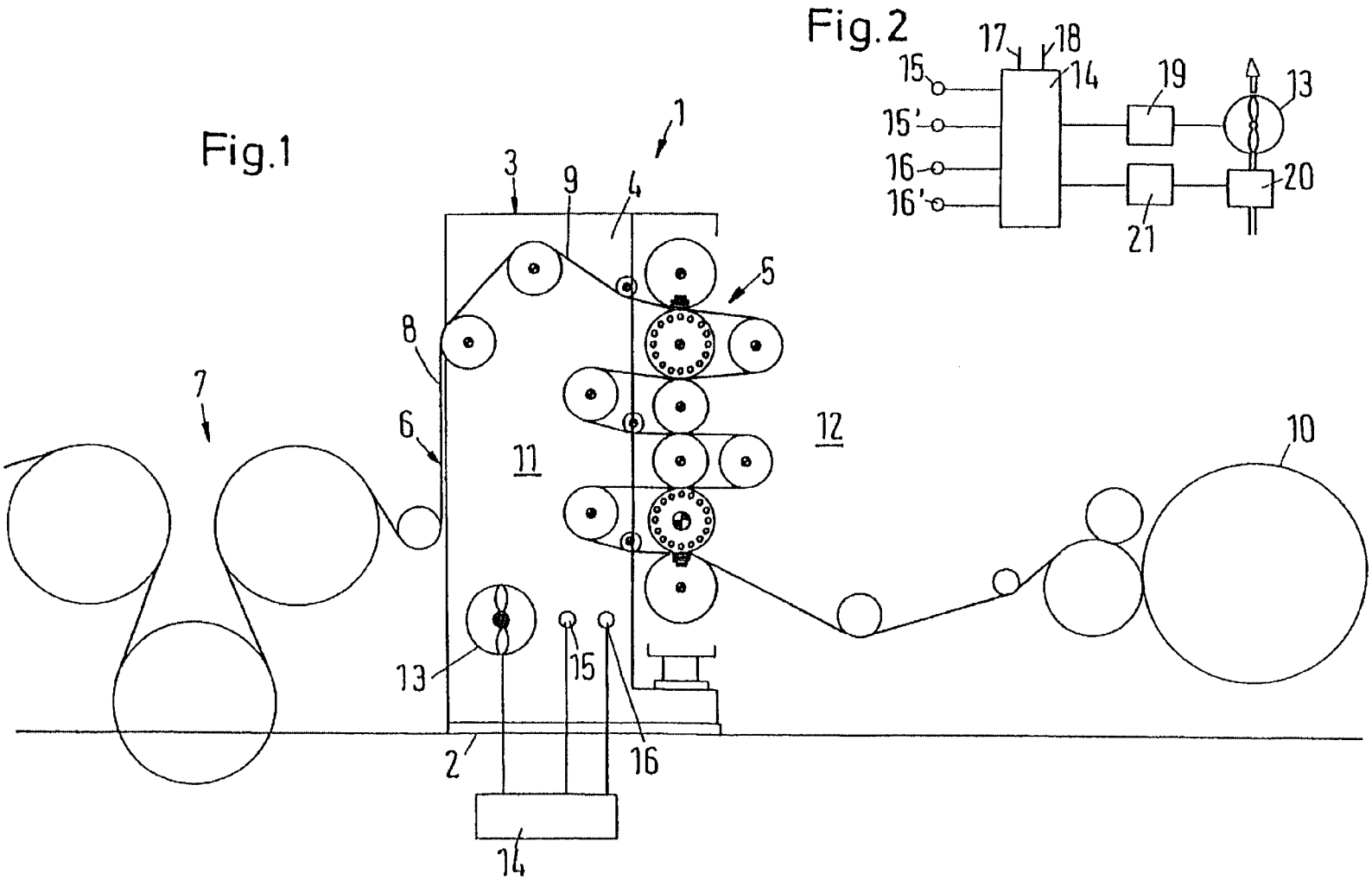
FIG. 1 shows a schematic representation of a calender according to the invention.
FIG. 2 shows an accompanying block diagram.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The calender 1 shown has a housing 3 standing on the floor 2 and having two side pieces 4, of which only the one side piece is visible. On the one face of the side pieces 4 is arranged a roll stack 5, to which a paper web 6 is fed from a dry roll arrangement 7 of a paper machine via a vertical section 8 on the face of the side pieces 4 opposite the roll stack 5 and via an upper section 9. The web 6 exits from the roll stack and is wound onto a winding device 10.

Between the space 11 limited by the floor 2, the roll stack 5, and the web sections 8 and 9. This space is only connected with the ambient atmosphere 12 via a few openings. A very high humidity state normally prevails in this space.

A fan 13 is provided that blows dry air into the limited space 11. The fan air data, such as amount, temperature, degree of drying, and the like are given by a computer and/or controller 14 governed by measured values of a moisture sensor 15 and a temperature sensor 16 and optionally other sensors which, for example, determine the relative humidity and the temperature of the atmosphere in the limited space 11.

In detail, this can take place as shown in the block diagram of FIG. 2. The computer/controller 14 is connected to each of two moisture sensors 15 and 15' as well as to two temperature sensors 16, 16' arranged at different points in the limited space 11, for example, on the side pieces 4. Theoretical and/or desired values for the moisture and the temperature in the limited space 11 are given to the computer 14 via inputs 17 and 18. The fan 13 has a device 19 for adjusting the amount of blast air, in the form of an adjustable motor controlled by the computer/controller 14. Upstream of the fan 13 is a heating device 20 that emits blast air at a temperature dictated by the computer 14, which is done by a device 21 for adjusting the temperature of the blast air, in the form of an adjustable heating current regulator.

The total arrangement can be operated in such a way that the blast air is fed in an amount, at a temperature, and at a degree of drying such that the atmosphere in the limited space 11 lies outside the saturation state, and therefore the formation of droplets and wetness is largely or completely avoided. In particular, the computer 14 can have a program that maintains or holds the atmosphere in the limited space 11 at a particularly desired point below the saturation state. Ideally, this point is close to the saturation state so that the web 6 is not exposed to an undesired drying as it passes through.

In an alternative embodiment, the fan 13 may function as an exhaust fan which allows the air within the limited space 11 to be exchanged. Moreover, the system may also use both an exhaust fan and an air delivery fan, each of which may be controlled by the computer and the other devices described herein. It should be noted that other air delivery and removal devices may be utilized. Furthermore, the fan may be located within the space, adjacent to it, or at a distance from it and connected to it via air delivery or removal conduits.

Ideally, the system should regulate the relative humidity, that is, the ratio of the mass of the water vapor contained in the air to the mass of the water vapor at saturation, in the range of approximately 75 to 95% and preferably between approximately 85 to 90%.

Additionally, instead of a single fan 13, several fans can be provided for introducing dry air into the limited space 11 at different points and/or from different locations on the calender.

The air of the ambient atmosphere itself suffices in many cases as the dry air. However, it is advisable to pre-dry the air, for example, by cooling it to below the dew point and then re-heating it.

Air is considered to be "dry" in the sense of the invention if its moisture content is less, preferably considerably less, than the moisture content of the atmosphere in the limited space 11. It is important for the blast air to mix with the air in the limited space 11 and for this mixture to have a moisture and a temperature just above the saturation temperature. For example, an overheating of 5 to 10° C. is preferred.

Moreover, the invention can also be used with a variety of calender configurations and designs such as those in which the side pieces carry a roll stack whose plane runs at an angle to the horizontal.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A calender for webs of moisture-containing material, comprising:

a housing having at least two side pieces and a-roll stack located at least partially between the side pieces, wherein a space is formed by the roll stack and the web between the side pieces; and a fan positioned to blow dry air into the space.

2. The calender of claim 1, wherein the material web comprises a paper web.

3. The calender of claim 1, wherein the dry air blown into the space comprises a relative humidity which is lower than the relative humidity of the air disposed in the space.

4. The calender of claim 1, further comprising a heating device for heating the dry air.

5. The calender of claim 1, further comprising at least one moisture sensor for measuring a humidity of the space and communicating the measurement to a computer.

6. The calender of claim 5, further comprising at least one temperature sensor for measuring a temperature of the space and communicating the measurement to a computer.

7. The calender of claim 6, further comprising a computer which receives inputs from the at least one moisture sensor and the at least one temperature sensor for adjusting the humidity of the space.

8. The calender of claim 7, further comprising an air adjusting device for regulating one of the air velocity entering the space and the quantity the air entering the space.

9. The calender of claim 8, wherein the air adjusting device comprises a computer controlled fan adjusting motor.

10. The calender of claim 7, further comprising an temperature adjusting device for regulating the temperature of the dry air entering the space.

11. The calender of claim 10, wherein the temperature adjusting device comprises a computer controlled adjustable heating current regulator.

12. The calender of claim 7, further comprising a computer program which manipulates input measurements from the at least one moisture sensor and the at least one temperature sensor and calculates outputs for regulating the humidity level within the space in the range of between approximately 75% and 95%.

13. A system for regulating the humidity in a calender, the calender being used to treat a moisture-containing material web and including a housing having at least two side walls and a roll stack, the calender defining a space bounded at least by the roll stack, the web, and the at least two side walls, the system comprising:

a device for reducing the humidity of the space, wherein the humidity level in the space is reduced to a level which is below a saturation point.

14. The system of claim 13, wherein the device for reducing the humidity comprises an air exchanging device.

15. The system of claim 13, wherein the device for reducing the humidity comprises a fan for removing air from the space.

16. The system of claim 13, wherein the device for reducing the humidity comprises a fan for blowing air into the space.

17. The system of claim 16, further comprising a heating device for heating the air.

18. The system of claim 13, further comprising at least one moisture sensor for measuring a humidity in the space and communicating the measurement to a regulating device.

19. The system of claim 18, further comprising at least one temperature sensor for measuring a temperature in the space and communicating the measurement to a regulating device.

20. The system of claim 19, wherein the regulating device comprises a computer which receives inputs from the at least one moisture and the at least one temperature sensors for adjusting the humidity of the space.

21. The system of claim 20, further comprising an air adjusting device for regulating one of the air velocity entering the space and the quantity the air entering the space.

22. The system of claim 21, wherein the air adjusting device comprises a computer controlled fan adjusting motor.

23. The system of claim 20, further comprising an temperature adjusting device for regulating the temperature of air entering the space.

24. The system of claim 23, wherein the temperature adjusting device comprises a computer controlled adjustable heating current regulator.

25. The system of claim 20, further comprising a computer program which manipulates input measurements from the at least one moisture sensor and the at least one temperature sensor and calculates outputs for regulating the humidity level within the space in the range of between approximately 75% and 95%.

26. A method of regulating the humidity in a calender, the calender being used to treat a moisture-containing material web and including a housing having at least two side walls and a roll stack, the calender defining a space bounded at least by the roll stack, the web, and the at least two side walls, the method comprising:

reducing the humidity of the space, wherein the humidity level in the space is reduced to a level which is below a saturation point.

27. The method of claim 26, wherein the reducing further comprises:

exchanging the air of the space with an air exchanging device.

28. The method of claim 26, wherein the reducing further comprises:

introducing air to the space using a fan.

29. The method of claim 26, wherein the reducing further comprises:

removing air from the space using an exhaust fan.

30. The method of claim 26, further comprising:

introducing air to the space using a fan.

31. The method of claim 26, further comprising:

measuring the humidity in the space with at least one sensor.

32. The method of claim 31, further comprising:

regulating the humidity of the space using a control device which receives inputs from the at least one sensor.

33. The method of claim 32, wherein the at least one sensor comprises at least one moisture sensor, and the method further comprises:

regulating the humidity of the space using a regulating device which receives inputs from the at least one moisture sensor.

34. The method of claim 33, wherein the at least one sensor comprises at least one temperature sensor, and the method further comprises:

regulating the humidity of the space using a control device which receives inputs from the at least one temperature sensor.

35. The method of claim 34, wherein the regulating further comprises:

maintaining the humidity in the space in the range of between approximately 75% and 95%.

36. A system for regulating the humidity in a calender, the calender being used to treat a moisture-containing material web and including a housing having at least two side walls and a roll stack, the calender defining a space bounded at least by the roll stack, the web, and the at least two side walls, the system comprising a device for reducing the humidity of the space;

at least one moisture sensor disposed within the space;

at least one temperature sensor disposed within the space;

a control device for receiving inputs from the at least one moisture sensor and the at least one temperature sensor;

wherein the control device controls the device for reducing the humidity so as to regulate the humidity level in the space to a point which is below a saturation point.

37. A method of regulating the humidity in a calender, the calender being used to treat a moisture-containing material web and including a housing having at least two side walls and a roll stack, the calender defining a space bounded at least by the roll stack, the web, and the at least two side walls, the method comprising:

measuring the humidity within the space with at least one moisture sensor;

measuring the temperature within the space with at least one temperature sensor;

comparing the humidity of the space to a desired value in a range using a computer which receives inputs from the at least one moisture sensor and the at least one temperature sensor; and regulating the humidity of the space to the desired value, wherein the humidity level in the space is reduced to a level which is within the range of between approximately 75% and 95%.

38. The calender of claim 1, further comprising at least one opening formed in at least one of the at least two side pieces, wherein the space is open to an ambient atmosphere through the at least one opening.

39. The system of claim 13, further comprising at least one opening formed in at least one of the at least two side walls, wherein the space is open to an ambient atmosphere through the at least one opening.

40. The method of claim 26, wherein at least one of the at least two side walls includes at least one opening, whereby the space is open to an ambient atmosphere through the at least one opening.

41. The system of claim 36, further comprising at least one opening formed in at least one of the at least two side walls, wherein the space is open to an ambient atmosphere through the at least one opening.

42. The method of claim 37, wherein at least one of the at least two side walls includes at least one opening, whereby the space is open to an ambient atmosphere through the at least one opening.

* * * * *